United States Patent [19]

Franklin, Jr. et al.

[11] 4,419,058

[45] Dec. 6, 1983

[54] HYDRAULIC PUMP ROTATING GROUP AXIAL ALIGNMENT STRUCTURE

[75] Inventors: Leonard N. Franklin, Jr., Reese; Gary G. Hegler, Chesaning, both of Mich.

[73] Assignee: General Motors Corporation, Detroit, Mich.

[21] Appl. No.: 271,661

[22] Filed: Jun. 8, 1981

[51] Int. Cl.[3] ..... F04C 2/00; F04C 15/00

[52] U.S. Cl. ..... 418/133; 418/135; 29/156.4 R; 403/14

[58] Field of Search ..... 418/70, 131, 133, 135, 418/39, 182, 270; 29/156.4 R, 464; 403/13, 14, 335, 337, 356

[56] References Cited

U.S. PATENT DOCUMENTS

| | | | |
|---|---|---|---|
| T927,009 | 10/1974 | Ulrich | 418/133 |
| 3,198,127 | 8/1965 | Brundage | 418/135 |
| 3,207,077 | 9/1965 | Zeigler et al. | 417/310 |
| 3,334,591 | 8/1967 | Dymond | 418/133 |
| 3,421,413 | 1/1969 | Adams et al. | 418/133 |
| 3,491,699 | 1/1970 | Yowell | 418/133 |
| 3,632,238 | 1/1972 | Searle | 418/39 |
| 3,827,834 | 8/1974 | Kakimoto | 418/270 |

FOREIGN PATENT DOCUMENTS

| | | | |
|---|---|---|---|
| 962131 | 2/1975 | Canada | 418/133 |
| 2312873 | 9/1974 | Fed. Rep. of Germany | 418/135 |

*Primary Examiner*—John J. Vrablik

*Attorney, Agent, or Firm*—Donald F. Scherer

[57] ABSTRACT

A vane type hydraulic pump has a pressure plate, thrust plate, cam ring, rotor and vanes, which when assembled, are denoted as the pump rotating group. The thrust plate, pressure plate and cam ring are maintained in axial and angular alignment by a pair of dowel pins which extend between the plates and through the cam ring with a close fit relationship. The plates and cam ring are restrained from rotation by a dowel pin which extends between a close fit in the pump housing and a loose fit in the pressure plate. The rotating group is disposed in a cylindrical cavity in the pump housing which cavity has a diametral dimension cooperating with the outer diameter of the pressure plate and thrust plate to provide a sliding pilot fit at assembly thereby sharing the axial alignment constraint of the pair of dowel pins.

2 Claims, 2 Drawing Figures

HYDRAULIC PUMP ROTATING GROUP AXIAL ALIGNMENT STRUCTURE

Figure 1:
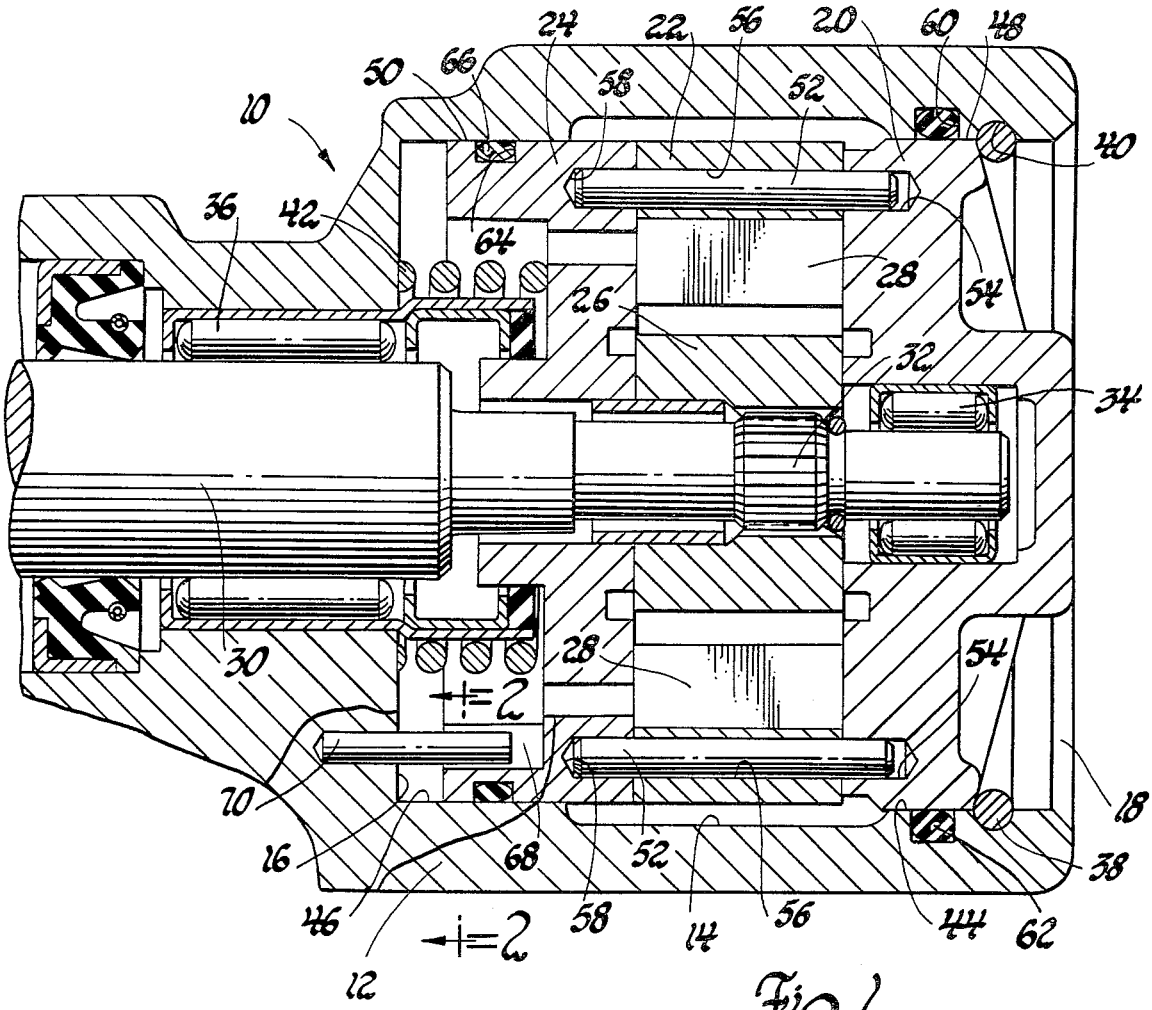

This invention relates to hydraulic type pumps and more particularly to such pumps having internal components maintained in axial alignment.

Power steering pumps are generally of the sliding vane type construction. It is common practice in such pumps to utilize dowel pins to maintain alignment between the outer plate members and the inner can ring. These dowel pins are also used to secure the outer plate members to the pump housing. In some instances, a single dowel pin and one or more threaded fastener members are used to maintain the desired alignment. It has, therefore, been necessary to provide sufficient clearance between the pump housing and the outer diametral surfaces of the cam and plate members so that manufacturing tolerances could be accommodated.

In these pumps, it was not economically feasible to provide controlled placement of the dowel pin holes in the pump housing with sufficient accuracy to permit close tolerances to exist between the pump housing and the outer diametral surfaces of the plate members. Thus, the housing member is larger than required by the pump package.

The present invention provides a dowel pin arrangement which permits the two plate members and the cam ring to be axially aligned and placed in a pump housing wherein a separate pin member engages one of the plate members to prevent rotary motion. The axial and angular alignment of the plates and cam ring is established by two dowel pins which extend between blind holes in the plate members and through apertures in the cam ring. The openings for the dowel pins are, of course, a close fit. The outer surfaces of the plate members and the inner cylindrical surface of the pump housing can be manufactured with sufficiently close tolerances to permit the plate members to be piloted in the housing. The rotating group, because of this alignment structure, can be completely assembled and stored prior to assembly in the pump housing and if necessary, can be shipped or otherwise handled in the subassembly configuration. Since the alignment dowel pins do not extend beyond the outer limits of the rotating group package, there is no possibility that they will be damaged during handling.

It is therefore an object of this invention to provide an improved hydraulic vane pump wherein the pressure plate, cam ring and thrust plate are axially aligned with a pair of dowel pins and wherein a third dowel pin non-rotatably connects the components to the pump housing.

Another object of this invention is to provide an improved hydraulic vane type pump having a cylindrical cavity piloting a thrust plate and pressure plate which are axially and angularly aligned with an intermediate cam ring by a pair of dowel pins and wherein a connector extends between one of the plates and an inner surface of the cavity to assure that relative rotation between the aligned members and the housing does not occur.

Figure 2:
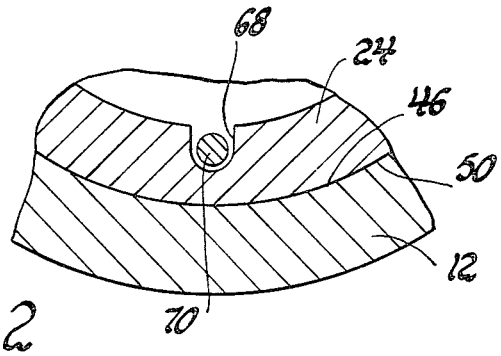

These and other objects and advantages of the present invention will be more apparent from the following description and drawings in which:

FIG. 1 is a cross-sectional elevational view of a slide vane type hydraulic pump; and FIG. 2 is a sectional view taken along line 2—2 of FIG. 1.

There is shown in FIG. 1 a power steering pump, generally designated 10, having a pump housing 12 which includes a cylindrical cavity 14 having a bottom wall 16 and an open end 18. The pump also includes a thrust plate 20, a cam ring 22, a pressure plate 24, and a rotor 26 in which is slidable disposed a plurality of vane members 28. The members 20 through 28 cooperate to provide a structure which is generally denoted as a rotating group. The rotating group could be considered as a pump in and of itself in that it contains the members necessary to establish a pumping function except for a rotary drive member.

The rotary drive is provided by a drive shaft 30 which is connected by a spline 32 to the rotor 26. The drive shaft 30 is rotatably supported in a roller bearing 34 secured in the thrust plate 20 and by a roller bearing and seal assembly 36 secured in the housing 12.

The rightward movement of the thrust plate 20 is limited by a retaining ring 38 which is secured in a groove 40 formed in the housing 12. A compression spring 42 is disposed between the bottom wall 16 and the pressure plate 24 so as to urge the rotating group toward the retaining ring 38. During pump operation, hydraulic fluid under pressure fills the space between the pressure plate 24 and the end wall 16 to assist the spring in maintaining the rotating group in the desired relationship.

The cylindrical cavity 14 has two cylindrical wall surfaces 44 and 46 which are sized to provide a pilot fit with the outer diameter 48 of the thrust plate 20 and the outer diameter 50 of the pressure plate 24, respectively. The outer diameters 48 and 50 are maintained in alignment by a pair of dowel pins 52. Each dowel pin 52 extends from a blind hole 54 in the thrust plate 20 through an aperture or opening 56 in the cam ring 22 and into a blind opening 58 formed in the pressure plate 24. The dowel pins 52 in the openings 54, 56 and 58 are machined to close tolerances which is common practice when dowel pins are utilized for alignment.

The cylindrical cavity 14 has a seal groove 60 formed therein in which is disposed a seal ring 62 which prevents fluid within the cylindrical cavity 14 from leaking to atmosphere at the right end of pump 10. The pressure plate 24 has a seal groove 64 in which is disposed a seal ring 66 which prevents the high pressure fluid between the end wall 16 and pressure plate 24 from leaking to the lower pressure fluid which surrounds the outer surface of the cam ring 22.

The pressure plate 24 has a U-shaped aperture 68 formed therein and extending toward the wall 16. A dowel pin 70 is secured in the housing 12 and extends perpendicular to the wall 16 and into the U-shaped aperture 68. This dowel pin absorbs the light torque reaction which occurs due to the rotation of the rotor 26 and vanes 28 inside the cam ring 22. The U-shaped aperture 68, as seen in FIG. 2, has a larger cross-sectional area than the dowel pin 70 such that there is a very loose fit between the pressure plate 24 and dowel pin 70.

If the retaining ring 38 is removed, the entire rotating group and drive shaft 30 can be removed from the pump housing. It is, therefore, possible to store or ship this group of parts as a subassembly. It is also possible to store and/or ship the rotating group parts without the drive shaft as a subassembly. Thus, it is a very simple matter to change the inner components of the pump should damage occur or by providing a lower or higher displacement cam ring and rotor, a different displacement pump can be assembled in the same housing.

While the dowel pins 51 provide an alignment constraint in the axial and angular direction prior to assembly within the pump housing, the close fit between the pump housing and the thrust and pressure plates allows the pump housing to share the alignment constraint. This also permits the inner diameter of the cylindrical cavity 14 to be maintained at a minimum dimension so that the overall housing size and weight is maintained at a minimum. This, of course, permits the use of less raw materials and reduces the total component weight.

While the rotary reaction is shown as being absorbed by a dowel pin, it is well within the state of the art to utilize a drive tang or other member formed either integrally with the pump housing and fitting a slot in one of the rotating group members or vice versa.

The embodiments of the invention in which an exclusive property or privilege is claimed are defined as follows:

1. A vane pump assembly comprising; a housing, a pressure plate piloted in said housing; a cam ring disposed in said housing adjacent said pressure plate; a thrust plate piloted in said housing adjacent said cam ring; a pair of alignment dowel pins each extending from a close fit in a blind opening in said pressure plate, through a close fit opening in said cam ring and into a close fit blind opening in said thrust plate to maintain axial and angular alignment of said plates and ring; and reaction means extending between said housing and said pressure plate in a loose fit relation in at least the circumferential direction for limiting rotary motion of said pressure plate relative to said housing, and through the alignment pins also limiting rotation of the thrust plate and cam ring.

2. A vane pump assembly comprising; a housing, a pressure plate piloted in said housing; a cam ring disposed in said housing adjacent said pressure plate; a thrust plate piloted in said housing adjacent said cam ring; a pair of alignment dowel pins each extending from a close fit in a blind opening in said pressure plate, through a close fit opening in said cam ring and into a close fit blind opening in said thrust plate to maintain axial and angular alignment of said plates and ring; and reaction pin means extending between a close fit blinding opening in said housing and a loose fit aperture in said pressure plate in at least the circumferential direction for preventing continuous rotation while controlling positioning of said pressure plate relative to said housing, and through the alignment pins also preventing rotation of the thrust plate and cam ring.

* * * * *